US009377002B2

(12) United States Patent
Singleton et al.

(10) Patent No.: US 9,377,002 B2
(45) Date of Patent: Jun. 28, 2016

(54) ELECTRODES FOR MULTI-POINT IGNITION USING SINGLE OR MULTIPLE TRANSIENT PLASMA DISCHARGES

(71) Applicants: Daniel R. Singleton, El Segundo, CA (US); Martin A. Gundersen, San Gabriel, CA (US); Jason M. Sanders, Los Angeles, CA (US); Andras Kuthi, Thousand Oaks, CA (US)

(72) Inventors: Daniel R. Singleton, El Segundo, CA (US); Martin A. Gundersen, San Gabriel, CA (US); Jason M. Sanders, Los Angeles, CA (US); Andras Kuthi, Thousand Oaks, CA (US)

(73) Assignee: UNIVERSITY OF SOUTHERN CALIFORNIA, Los Angeles, CA (US)

( * ) Notice: Subject to any disclaimer, the term of this patent is extended or adjusted under 35 U.S.C. 154(b) by 191 days.

(21) Appl. No.: 14/185,729

(22) Filed: Feb. 20, 2014

(65) Prior Publication Data

US 2014/0230790 A1 Aug. 21, 2014

Related U.S. Application Data

(60) Provisional application No. 61/767,051, filed on Feb. 20, 2013.

(51) Int. Cl.
*F02P 15/04* (2006.01)
*F02P 15/08* (2006.01)
(Continued)

(52) U.S. Cl.
CPC ..... *F02P 15/04* (2013.01); *F02P 15/08* (2013.01); *F02P 15/10* (2013.01); *F02P 23/04* (2013.01);
(Continued)

(58) Field of Classification Search
CPC ..... F02P 15/04; F02P 15/10; F02P 15/08; H01T 13/24; H01T 13/20; F02B 23/00
USPC ..... 123/636, 143 B, 606, 162; 313/139, 313/141, 143
See application file for complete search history.

(56) References Cited

U.S. PATENT DOCUMENTS 1,371,797 A * 3/1921 McCandless ..... F02P 15/04 123/162
1,401,231 A * 12/1921 Anderson ..... F02P 15/04 123/143 R
(Continued)

FOREIGN PATENT DOCUMENTS

DE 3407951 A1 * 7/1985 ..... F02P 15/04
GB 269197 A * 8/1927 ..... F02P 15/04
(Continued)

OTHER PUBLICATIONS

US International Searching Authority: International Search Report and Written Opinion of the International Searching Authority (ISA/US), dated May 30, 2014, for PCT Application PCT/US2014/017441, filed Feb. 20, 2014.
(Continued)

*Primary Examiner* — Mahmoud Gimie
(74) *Attorney, Agent, or Firm* — McDermott Will & Emery LLP

(57) ABSTRACT

A device for providing ignition of a fuel-air mixture using a transient plasma discharge is provided. The device includes an anode coupled to receive a voltage; and a cathode disposed in proximity to the anode and coupled to a ground, wherein at least one of the anode and the cathode includes a protrusion that enhances an electric field formed between the anode and the cathode, the protrusion forming a sharp edge defining a plurality of points, each point forming a path of shortest distance between the anode and the cathode.

19 Claims, 5 Drawing Sheets

(51) Int. Cl.

| | |
|---|---|
| ***H01T 13/20*** | (2006.01) |
| ***H01T 13/24*** | (2006.01) |
| ***F02P 15/10*** | (2006.01) |
| ***F02P 23/04*** | (2006.01) |
| ***H05H 1/48*** | (2006.01) |
| ***H01T 13/50*** | (2006.01) |

(52) U.S. Cl.
CPC ..... *H01T 13/20* (2013.01); *H01T 13/24* (2013.01); *H01T 13/50* (2013.01); *H05H 1/48* (2013.01); *H05H 2001/483* (2013.01)

(56) References Cited

U.S. PATENT DOCUMENTS

| | | | | |
|---|---|---|---|---|
| 1,542,504 | A * | 6/1925 | Heide | F02P 15/04 123/169 CB |
| 1,985,192 | A * | 12/1934 | O'Marra | H01T 13/467 137/537 |
| 2,109,364 | A | 2/1938 | Bornemann | |
| 4,487,177 | A | 12/1984 | Ishikawa | |
| 4,835,960 | A | 6/1989 | Skoczkowski et al. | |
| 5,813,385 | A | 9/1998 | Yamauchi et al. | |
| 5,984,668 | A | 11/1999 | Hansen et al. | |
| 6,121,719 | A | 9/2000 | Matsutani | |
| 6,121,720 | A * | 9/2000 | Rossi | H01T 13/467 313/118 |
| 6,334,982 | B1 | 1/2002 | Carlow et al. | |
| 6,628,049 | B2 * | 9/2003 | Rosenthal | H01T 13/467 313/141 |
| 7,182,076 | B1 * | 2/2007 | Minker | F02P 23/045 123/143 B |
| 8,044,560 | B2 * | 10/2011 | Steigleman, Jr. | H01T 13/20 313/118 |
| 2011/0297116 | A1 | 12/2011 | Ruan et al. | |

FOREIGN PATENT DOCUMENTS

| | | | |
|---|---|---|---|
| WO | WO00/01047 | A1 | 1/2000 |
| WO | WO2011101155 | A1 | 8/2011 |

OTHER PUBLICATIONS

US International Searching Authority: International Search Report and Written Opinion of the International Searching Authority (ISA/US), dated Jun. 2, 2014, for PCT Application PCT/US2014/017450, filed Feb. 20, 2014.

* cited by examiner

ELECTRODES FOR MULTI-POINT IGNITION USING SINGLE OR MULTIPLE TRANSIENT PLASMA DISCHARGES

CROSS-REFERENCE TO RELATED APPLICATION

This application is based upon and claims priority to U.S. provisional patent application 61/767,051, entitled "Electrodes for Multi-Point Ignition Using Single or multiple transient plasma discharges," filed Feb. 20, 2013.

The entire content of the above provisional applications is incorporated herein by reference.

STATEMENT REGARDING FEDERALLY SPONSORED RESEARCH

This invention was made with government support under Grant No. N00014-09-C-0391, awarded by the Office of Naval Research (ONR). The government has certain rights in the invention.

BACKGROUND

Technical Field

This disclosure relates to methods and systems to ignite a fuel. More particularly, this disclosure relates to methods and systems including electrodes for ignition using transient plasma discharges for internal combustion engines.

Automotive internal combustion (IC) engines are under strict control by emission legislation due to growing concerns about their environmental impact, and the regulations are becoming more challenging for the industry to meet. IC engines play a dominant role in U.S. transportation and are expected to continue to do so well beyond 2020. The United States has roughly 300 million automobiles on the road that use approximately 130 billion gallons of gasoline per year and create an annual environmental burden of 1.2 billion metric tons of $CO_2$. Factoring in Diesel engines in the U.S. which burn an additional 50 billion gallons of fuel per year, combustion of liquid fuels in the U.S. annually adds close to 1.5 billion metric tons of $CO_2$ into the environment. The U.S. Department of Energy has placed a high-priority has been placed on solutions for improving fuel efficiency and reducing emissions in the near term.

Federal Mogul has taken one approach to transient plasma (or corona) ignition, with a star shaped electrode, using radio frequency discharges. However, these applications have thus far failed to provide efficient and reliable operation.

SUMMARY

According to a first embodiment, a device for providing ignition of a fuel-air mixture using a transient plasma discharge may include an anode configured to receive a voltage and a cathode disposed in proximity to the anode and configured to be coupled to a ground. Further, at least one of the anode and the cathode in the device may include a protrusion that enhances an electric field formed between the anode and the cathode, and wherein the protrusion forms a sharp edge defining a plurality of points, each point forming a path of shortest distance between the anode and the cathode.

According to a second embodiment, an internal combustion engine may include a fuel injector and an air intake coupled to provide a fuel-air mixture and a cavity configured to contain a combustion. The cavity may further include an internal surface fixed to the engine; a piston; an anode configured to receive a voltage; and a cathode disposed in proximity to the anode, the cathode configured to be coupled to a ground. More specifically, at least one of the anode and the cathode may include a protrusion that enhances an electric field formed between the anode and the cathode, and wherein the protrusion forms a sharp edge defining a plurality of points, each point forming a path of shortest distance between the anode and the cathode.

In yet another embodiment, a method for igniting a fuel-air mixture with a transient plasma discharge may include forming a fuel-air mixture by combining an approximately stoichiometric amount of a fuel with air; delivering the fuel-air mixture to a cavity having an anode and a cathode proximal to each other; and providing a voltage pulse to the anode. Accordingly, at least one of the anode and the cathode includes a protrusion that enhances an electric field formed between the anode and the cathode, and the protrusion forms a sharp edge defining a plurality of points, each point forming a path of shortest distance between the anode and the cathode.

These, as well as other components, steps, features, objects, benefits, and advantages, will now become clear from a review of the following detailed description of illustrative embodiments, the accompanying drawings, and the claims.

BRIEF DESCRIPTION OF DRAWINGS

The drawings are of illustrative embodiments. They do not illustrate all embodiments. Other embodiments may be used in addition or instead. Details that may be apparent or unnecessary may be omitted to save space or for more effective illustration. Some embodiments may be practiced with additional components or steps and/or without all of the components or steps that are illustrated. When the same numeral appears in different drawings, it refers to the same or like components or steps.

DETAILED DESCRIPTION OF ILLUSTRATIVE EMBODIMENTS

Figure 1A:
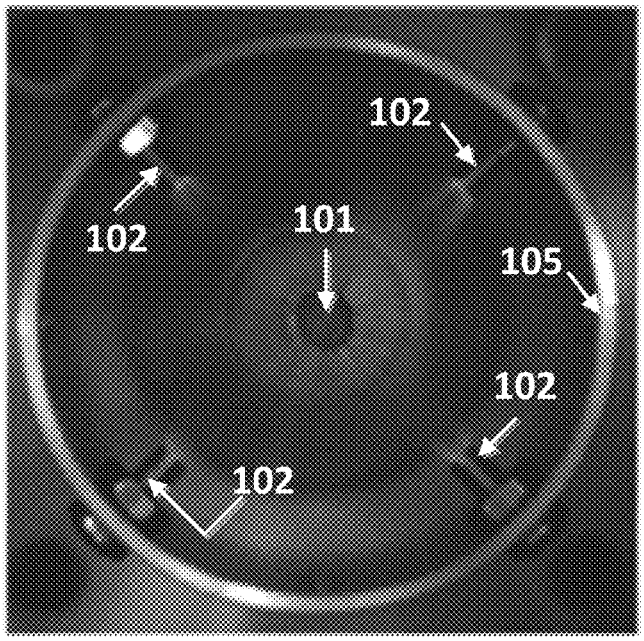
FIGS. 1A-1B: Illustrate an electrode with field enhancement at four protrusions from the cathode, according to some embodiments.

Illustrative embodiments are now described. Other embodiments may be used in addition or instead. Details that may be apparent or unnecessary may be omitted to save space or for a more effective presentation. Some embodiments may be practiced with additional components or steps and/or without all of the components or steps that are described.

In an effort to achieve better fuel efficiency together with low emissions, modern IC engines are equipped with complicated injection and/or exhaust gas recirculation (EGR) systems. Diesel engines have better fuel efficiency and lower carbon monoxide (CO) and unburned hydro carbon (UHC)

emission levels compared with spark ignition (SI) engines, however, they are generally characterized by high levels of nitrogen oxides (NOx) and soot emissions due to the nature of diffusion flame combustion. Examples of such engines may be found in the paper by Chang-Wook Lee, Rolf D. Reitz, Eric Kurtz, "A Numerical Study on Diesel Engine Size-Scaling in Low Temperature Combustion Operation", Numerical Heat-Transfer, Part A: Applications, Vol. 58, Iss. 9, 2010, incorporated herein by reference in its entirety, for all purposes. Low temperature combustion (LTC) operation in diesel engines has the potential to suppress NOx and soot emissions simultaneously; however, the long ignition delays that are the result of dilute combustion in LTC operation causes problems with combustion noise. Examples of LTC engines may be found in the following papers: (i) Y. Iwabuchi, L. Kawai, T. Shoji, and T. Takeda, Trial of New Concept Diesel Combustion System—Premixed Compression Ignition Combustion, SAE Technical Paper, SAE 1999-01-0185, 1999; (ii) S. Kimura, O. Aoki, H. Ogawa, S. Muranaka, and Y. Enomoto, New Combustion Concept for Ultra-Clean and High-Efficiency Small DI Diesel Engines, SAE Technical Paper, SAE 1999-01-3681, 1999; and (iii) K. Akihama, Y. Takitori, K. Unagaki, S. Sasaki, and A. Dean, Mechanism of Smokeless Rich Diesel Combustion by Reducing Temperature, SAE Technical Paper, SAE 2001-01-0655, 2001; which are incorporated herein by reference in their entirety, for all purposes. Transient plasma, generated by nanosecond pulsed power, has consistently demonstrated significant improvements in ignition delay and is potentially an enabling technology for improving efficiency and reducing in emissions in diesel engines. Some examples of transient plasma ignition may be found in the following papers: (i) F. Wang, J. B. Liu, J. Sinibaldi, C. Brophy, A. Kuthi, C. Jiang, P. Ronney, and M. Gundersen, "Transient Plasma Ignition of Quiescent and Flowing Air/Fuel Mixtures," IEEE Transactions on Plasma Science, Vol. 33, No. 2, pp. 844-849, April 2005; (ii) J. B. Liu, F. Wang, G. Li, A. Kuthi, E. Gutmark, P. Ronney, and M. A. Gundersen, "Transient Plasma Ignition," IEEE Transactions on Plasma Science, Special edition on Images, Vol. 33, No. 2, pp. 326-327, April 2005; (iii) C. Cathey, T. Tang, T. Shiraishi, T. Urushihara, A. Kuthi, and M. A. Gundersen, "Nanosecond Plasma Ignition for Improved Performance of an Internal Combustion Engine," IEEE Trans on Plasma Sci., December 2007? Volume: 35, 6, Part 1, 1664-1668; (iv) D. Singleton, S J. Pendleton, and M. A. Gundersen, "The role of non-thermal transient plasma for enhanced flame ignition in C2H4-air," J. Phys. D: Appl. Phys. 44 (2011) 022001; and (v) D. Singleton and M. A. Gundersen, "Transient Plasma Fuel-Air Ignition," IEEE Transactions on Plasma Science, vol. 39, no. 11, pp. 2214-2215, November 2011; which are incorporated herein by reference in their entirety, for all purposes.

Current electrodes for IC engines allow for a single discharge path, which is all that can be utilized with spark ignition technology. The electrode designs disclosed below allow for a single discharge to affect a larger volume and allows for multipoint ignition in the engine cylinder.

Multi-point ignition with a single or multiple low-energy discharges. Spatially separated ignition sites improve combustion efficiency. Modifications to the engine cylinder or cylinder head may be necessary. In some embodiments, the distance between the anode and the plurality of cathodes is similar for several cathodes points. Accordingly, some embodiments have an equal distance between the anode and each of the cathodes in the plurality of cathodes.

The highest peak brake thermal efficiency (BTE) of passenger vehicle engines is slightly above 40%, meaning that somewhat more than 40% of the energy released by burning the fuel is converted into work by the crankshaft under ideal operating conditions. This is discussed in detail in the paper "Summary Report on the Transportation Combustion Engine Efficiency Colloquium" held at USCAR, Mar. 3 and 4, 2010; which is incorporated herein by reference in its entirety, for all purposes. The maximum BTE that could be achieved with slider-crank architecture (the dominant mechanical architecture of current engines) is about 60%, assuming that cost is not a constraint, as described in detail in the USCAR reference cited above. The theoretical peak energy efficiency limits for combustion engines are constrained by the $1^{st}$ and $2^{nd}$ Laws of Thermodynamics as they apply to the chemical and physical processes involved in converting fuel chemical energy into force and motion. This is described in detail in the paper by C. D. Rakopoulos and E. G. Giakoumis, "Second-law analysis applied to internal combustion engine operation," Progress in Energy and Combustion Science, vol. 32, pp 2-47 (2006), which is incorporated herein by reference in its entirety, for all purposes. Although none of the combustion heat is destroyed (guaranteed by the $1^{st}$ Law), the $2^{nd}$ Law of Thermodynamics prevents a significant portion of the heat from being transformed into useful work. This is described in detail in the paper by N. Lior and G. J. Rudy, "Second-law Analysis of an Ideal Otto Cycle, Energy Conversion and Management, vol. 28, no. 4, pp 327-334 (1988), which is incorporated by reference in its entirety, herein, for all purposes. 20-25% of the fuel energy is destroyed by the unrestrained combustion of hydrocarbon fuels (i.e., when the combustion reactions occur far from thermodynamic equilibrium). This large loss of useful energy due to combustion irreversibility is an inherent feature of all current combustion engines.

It is possible to improve peak efficiency for slider-crank combustion engines by lowering combustion temperatures. Low temperature combustion (LTC) improves engine efficiency primarily because of reduced cylinder heat losses (due to the lower combustion temperature) and the potential for very dilute combustion (due to different reaction kinetics). By reducing cylinder heat losses and changing the molecular properties of the expanding combustion gases, LTC allows more of the energy released by combustion to be extracted in the expansion stroke. The lower reaction temperatures in LTC are also useful for reducing engine out NOx emissions, thereby reducing the need to consume additional fuel for exhaust after treatment. Various versions of LTC have been intensely investigated for the past several years.

The biggest challenge in widely implementing LTC is that it is less stable and more difficult to control than conventional diesel and spark ignition combustion, especially at high loads where engine efficiencies are high. Some modes of LTC are also apparently sensitive to small changes in fuel properties. While some engine LTC experiments have apparently demonstrated peak net indicated efficiencies in excess of 55%, this has been achieved under idealize laboratory conditions. Another important constraint is that past work has indicated higher engine efficiency appears to correlate with lower power density, thus a challenge for future development will be to obtain higher efficiencies while still maintaining or increasing specific power. Transient plasma has demonstrated the potential to stabilize and control LTC while maintaining power and allowing the use of more difficult to burn fuels. Transient plasma LTC in embodiments consistent with the present disclosure may be as described in detail in the following papers: (i) D. Singleton, J. Sinibaldi, C. Brophy, A. Kuthi and M. A. Gundersen, "Compact Pulsed Power System for Transient Plasma Ignition", IEEE Transactions of Plasma Science, IEEE Trans. Plasma Sci. 37 (12), 2275-2279, 2009;

(ii) D. Singleton, A. Kuthi, J. M. Sanders, A. Simone, S. J. Pendleton, and M. A. Gundersen, "Low Energy Compact Power Modulators for Transient Plasma Ignition," Vol. 18, No. 4, pp. 1084-1090, August 2011; and (iii) T. Shiraishe, T. Urushihara and M. Gundersen, "A Trial of Ignition Innovation of gasoline engine by nanosecond pulsed low temperature plasma ignition," Journal of Physics D: Applied Physics, 42 (2009) 135208 12 pp. which are incorporated herein by reference in their entirety, for all purposes.

Transient plasma ignition, involving short ignition pulses (typically 10-50 ns), has been shown to effectively reduce ignition delays and improve engine performance for a wide range of combustion-driven engines relative to conventional spark ignition. This methodology is therefore potentially useful for many engine applications. It has demonstrated several advantages over traditional non-enhanced thermal ignition:

1) Ignites fuel more quickly
2) Easily ignites complex fuels
3) Ignites leaner mixture
4) Increases burning rate The short nanoseconds pulses ensure that the electric field couples energy through energetic electrons rather than through heating of the fuel-air mixture (as occurs during a normal spark discharge, with pulses of micro-second—μs- to mili-second—ms—duration) due to the highly non-equilibrium transient plasma. The mechanism responsible for demonstrated improvements is believed to be impact ionization from high energy electrons produced by the discharge. These electrons collide with neutrals, producing radicals that drive and enhance the combustion process. Accordingly, some of the radicals produced may include atomic Oxygen (O) in its ground state, or Hydrogen radicals. The result is improved efficiency and reduced emissions from a variety of engine types, showing more than a 20% increase in efficiency in some engines.

In order to investigate the cause of the location of ignition using nanosecond pulses, screws were added to the cathode to create four points where local electric field enhancement would occur. During a transient plasma discharge, the intensity of optical emission from the streamers was observed to be highest at the tip of the screws, as well as along the anode. This supports the hypothesis that this configuration produces increased densities of active species at the cathode compared to the traditional constant gap coaxial geometry. In some embodiments, a single 12 ns, 50 kV pulse may be applied to a fuel-to-air equivalence ratio, $\phi$, of about 1.1 $C_2H_4$-air mixture. In such configuration, ignition may occur almost simultaneously at the tip of each screw, as well as at the bases of the streamer channels along the anode (cf. FIG. 1B). These results confirmed that ignition occurs where the electric field is enhanced in the streamer channels, whether that is near the anode or the cathode.

This result is significant because it implies that multiple spatially separated ignition sites can be generated efficiently and employed to improve combustion efficiency. It is worth noting a useful benefit in that the energy distributed to each site is small—the overall energy requirement is approximately the same or less than that required for traditional spark ignition, and some reduction in electrode erosion may be anticipated.

Here disclosed are several different configurations of electrodes that utilize the discovery that enhancing the electric field locally with sharp points can distribute plasma generation sites. This approach is particularly enabled by transient plasma, as the field is distributed throughout the volume even if the streamers subsequently become quenched.

Figure 1B:
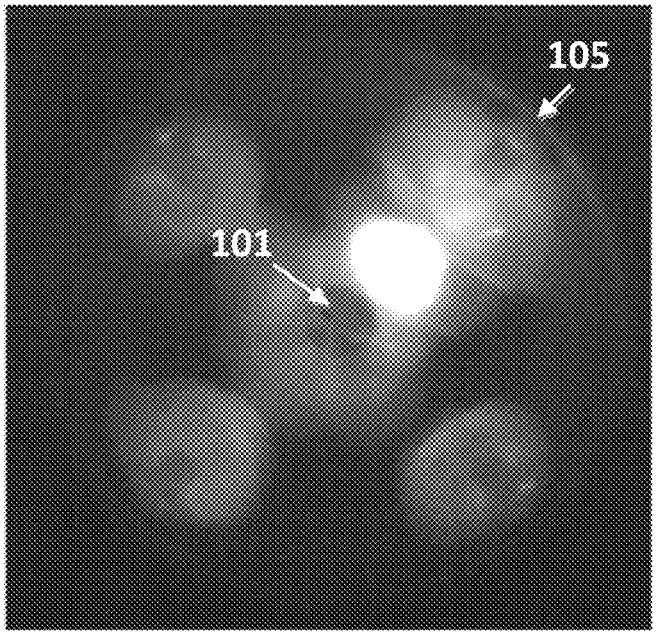

FIGS. 1A-1B illustrate an electrode with field enhancement at four protrusions 102 from the cathode 105, according to some embodiments. The anode 101 in FIGS. 1A-1B is placed approximately at the same distance from each of protrusions 102. Accordingly, FIGS. 1A-1B show an embodiment where sharp points 102 are added to the cathode (grounded side) via 8-32 stainless steel threaded screws promote electric field enhancement and thus allow multipoint ignition. The materials for the electrode containing both the anode 101 and cathode 105 may be stainless steel or other suitable materials. The anode 101 where high-voltage is applied in this configuration is also an 8-32 threaded rod be may be any size, typically between 0.1 and 10 mm. The threads are one embodiment of sharp points 102 to promote field enhancement. Voltages amplitude(s) may be between 1 kV and 100 kV having a duration between 1 ns and 1 μs. FIG. 1A shows an image of the transient plasma resulting from ten pulses having 12 ns duration each, with a 50 kV Voltage difference between the anode 101 and the cathode 105, when the system is immersed in air. FIG. 1B shows ignition occurring at multiple locations after a single pulse has been produced, in a $\phi$=1.1 $C_2H_4$-air mixture.

Figure 2:
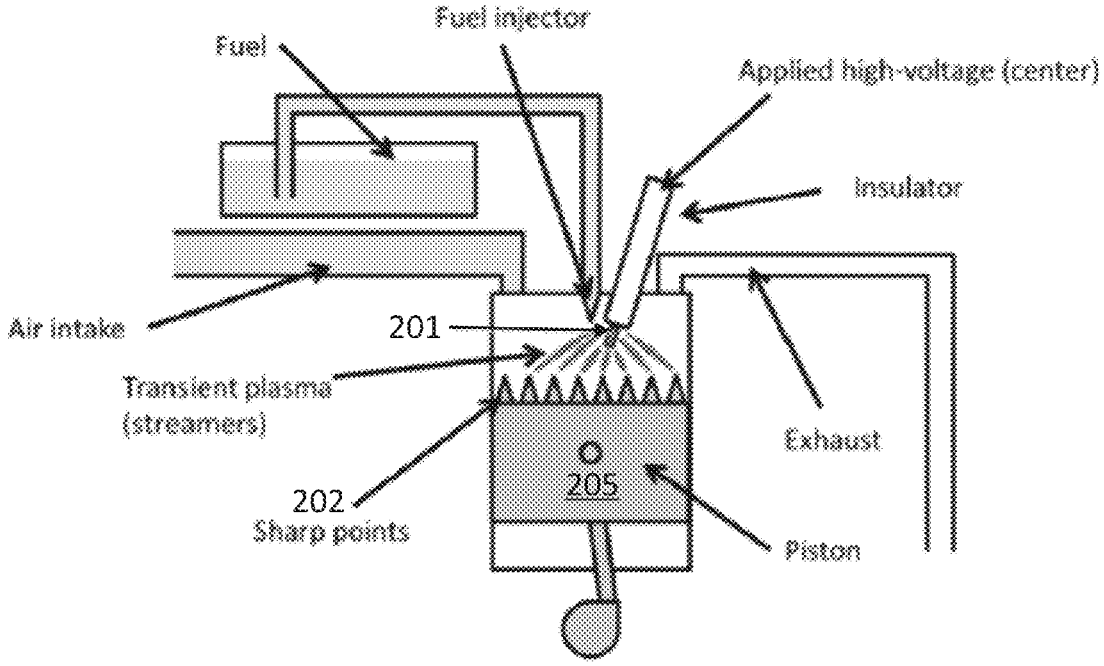
FIG. 2: Illustrates an electrode configuration where sharp points are added to the piston, according to some embodiments.

FIG. 2 illustrates an electrode configuration where sharp points 202 are added to the piston, according to some embodiments. Accordingly, FIG. 2 shows one embodiment where sharp points 202 are added to the cathode 205 (grounded side) which in this case is the Piston. FIG. 2 shows the engine system, where fuel is delivered to the engine cylinder via a Fuel Injector, and air is brought in through an Air Intake. The fuel-air mixture is ignited via Transient Plasma, which is produced by applying a nanoseconds high-voltage pulse or pulses to the anode 201. An Insulator prevents electric breakdown anywhere except in the chamber. The combusted products then exit via the exhaust.

Figure 3:
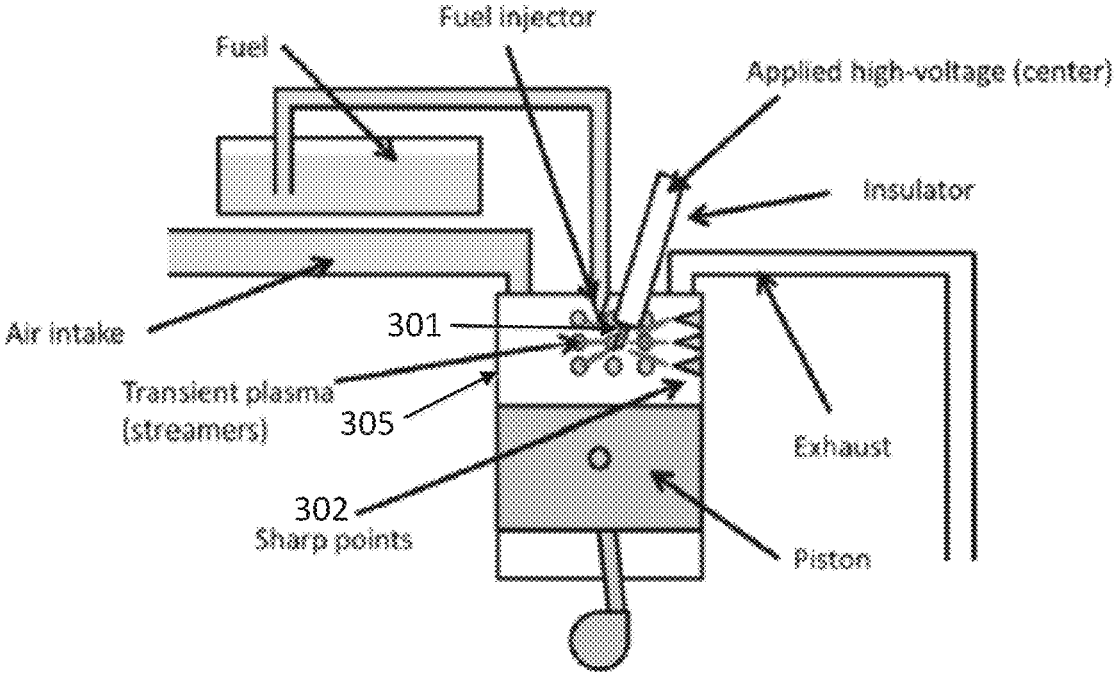
FIG. 3: Illustrates an electrode configuration where sharp points are added to the cylinder wall, according to some embodiments.

FIG. 3 illustrates an electrode configuration where sharp points 302 are added to the cylinder wall, according to some embodiments. Accordingly, FIG. 3 shows one embodiment where sharp points 302 are added to the cathode 305 (grounded side) which in this case includes the cylinder wall. More generally, the cylinder wall of the internal combustion engine illustrated in FIG. 3 may be any internal surface fixed to the engine and forming a cavity configured to contain the fuel combustion. FIG. 3 shows the engine system, where fuel is delivered to the engine cylinder via a fuel Injector, and air is brought in through an Air Intake. The fuel-air mixture is ignited via Transient Plasma, which is produced by applying a nanoseconds high-voltage pulse, or a plurality of pulses to the anode 301. An Insulator prevents electric breakdown anywhere except in the chamber. The combusted products then exit via the exhaust.

Figure 4:
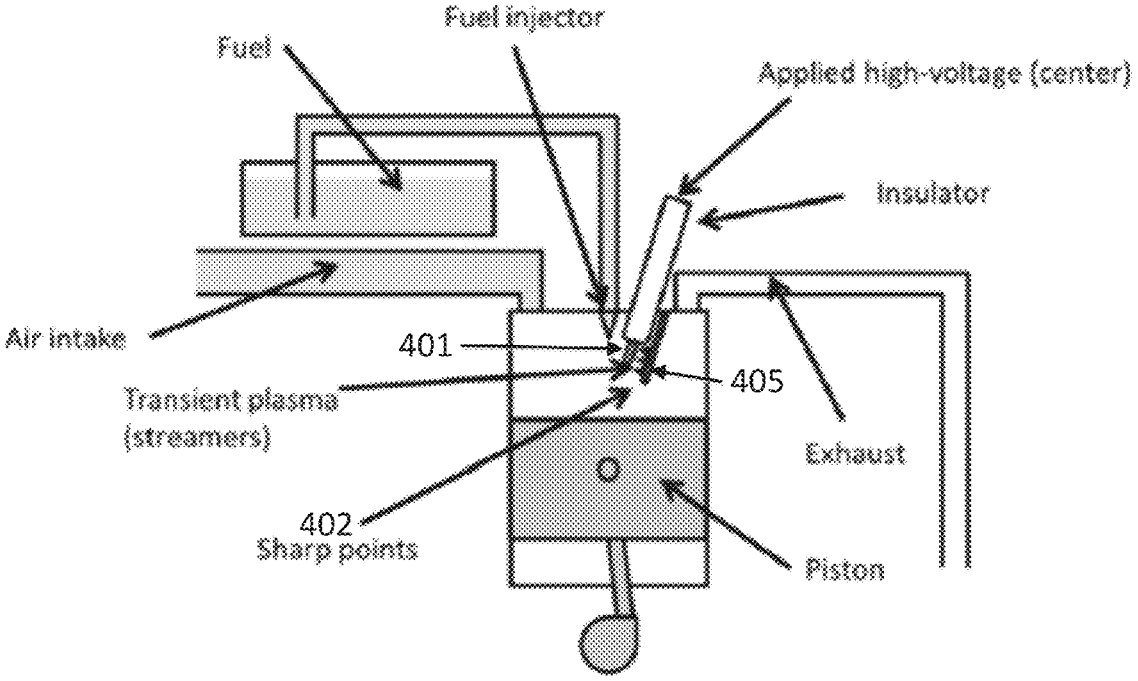
FIG. 4: Illustrates an electrode configuration where sharp points are added to an internal cathode, according to some embodiments.

FIG. 4 illustrates an electrode configuration where sharp points 402 are added to an internal cathode 405, according to some embodiments. Accordingly FIG. 4 shows sharp points included in the cathode 405 (grounded side) which in this case is a piece of metal which protrudes into the cylinder. FIG. 4 shows the engine system, where Fuel is delivered to the engine cylinder via a Fuel Injector, and air is brought in through an Air Intake. The fuel-air mixture is ignited via Transient Plasma, which is produced by applying a nanoseconds high-voltage pulse or pulses to the anode 401. An Insulator prevents electric breakdown anywhere except in the chamber. The combusted products then exit via the exhaust.

FIGS. 5A-5H illustrate different electrode configurations adapted for multi-point ignition using multiple transient plasma discharge, according to embodiments disclosed herein. In that regard, FIGS. 5A-5H show multiple embodiments where sharp points are used to encourage multi-point ignition in an engine where transient plasma is applied. Accordingly, sharp points in embodiments as illustrated in FIGS. 5A-5H may be formed in the anode 501A-H, in the cathode 505A-H, or in both anode and cathode for each of the configurations. The embodiments in FIGS. 5A-5H may include spark plugs based on standard 12 mm spark plug designs, but may be larger or smaller. As shown in 5A, the anode is the center electrode where the high-voltage pulse or pulses are applied, and the cathode is the grounded shell which is in contact with the engine.

Figure 5A:
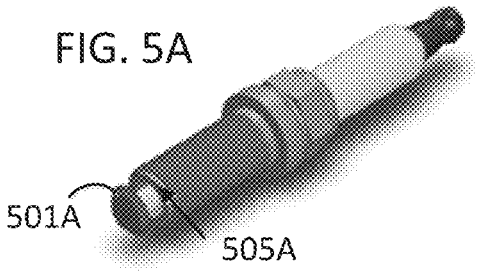
FIGS. 5A-5H: Illustrate different electrode configurations adapted for multi-point ignition using multiple transient plasma discharge, according to embodiments disclosed herein.
Figure 5B:
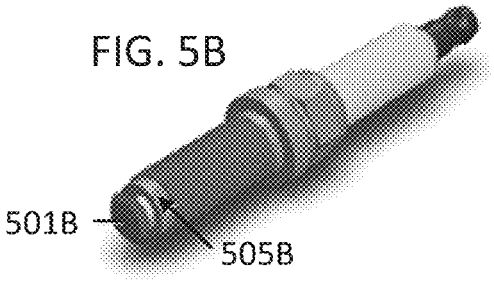
Figure 5C:
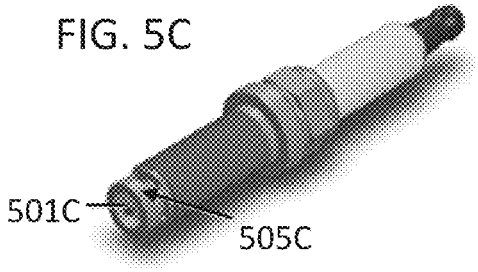
Figure 5D:
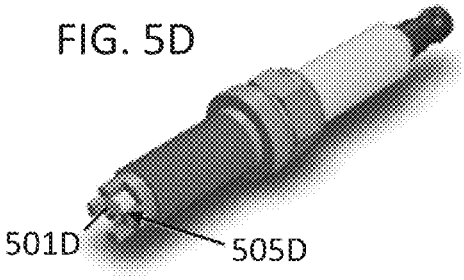
Figure 5E:
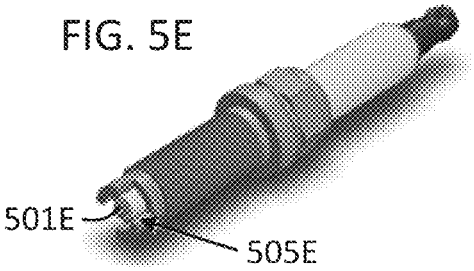
Figure 5F:
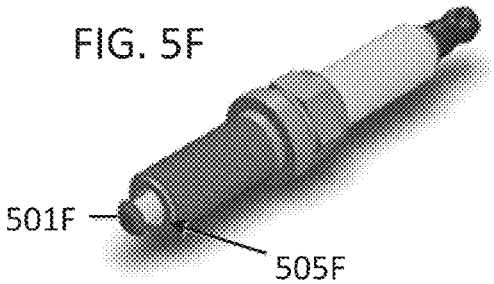
Figure 5G:
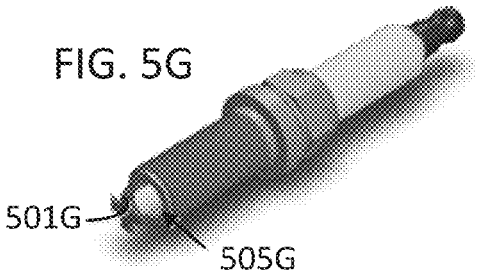
Figure 5H:
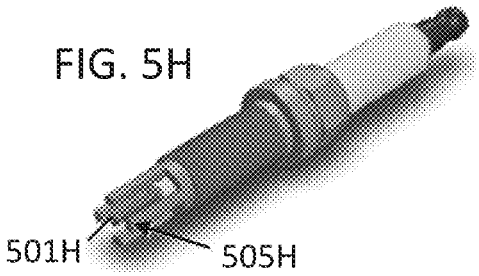

FIG. 5A shows a disc anode 501A which may be nickel, silver, copper, or another suitable material, matched to outer diameter of cathode 505A, which promotes multipoint ignition in volumetrically distributed regions. FIG. 5B shows a disc anode 501B which may be nickel, silver, copper, or another suitable material, matched to outer diameter of cathode 505B with extended cathode to control the discharge gap between the anode and the cathode, which may be 0.1 mm to 40 mm, but typically 1 mm to 4 mm. FIG. 5C shows an extended cathode 505C with holes that allow uniform streamer distribution around anode 501C. FIG. 5D shows anode 501D and an extended cathode 505D similar to grounding arms on a standard spark plug. Sharp edges may enhance chance of ignition at cathode 505D. FIG. 5E shows anode 501E and an extended cathode 505E similar to a grounding arm. This configuration allows fuel-air access between the electrodes. FIG. 5F shows a disc anode 501F matched to an inner diameter of cathode 505F. Embodiments consistent with FIG. 5F reduce the likelihood of problems with heat transfer to the plug and subsequent failure. FIG. 5G shows cathode 505G and a cross anode 501G to promote multipoint ignition while preventing heat transfer issues. And FIG. 5H shows cathode 505H and an extended anode 501H that promote multi-point ignition. One of ordinary skill will recognize that any suitable combination of any of anodes 501A-H and cathodes 505A-H may be used in a multi-point ignition apparatus consistent with the present disclosure.

The components, steps, features, objects, benefits, and advantages that have been discussed are merely illustrative. None of them, nor the discussions relating to them, are intended to limit the scope of protection in any way. Numerous other embodiments are also contemplated. These include embodiments that have fewer, additional, and/or different components, steps, features, objects, benefits, and advantages. These also include embodiments in which the components and/or steps are arranged and/or ordered differently.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

All articles, patents, patent applications, and other publications that have been cited in this disclosure are incorporated herein by reference.

The phrase "means for" when used in a claim is intended to and should be interpreted to embrace the corresponding structures and materials that have been described and their equivalents. Similarly, the phrase "step for" when used in a claim is intended to and should be interpreted to embrace the corresponding acts that have been described and their equivalents. The absence of these phrases from a claim means that the claim is not intended to and should not be interpreted to be limited to these corresponding structures, materials, or acts, or to their equivalents.

The scope of protection is limited solely by the claims that now follow. That scope is intended and should be interpreted to be as broad as is consistent with the ordinary meaning of the language that is used in the claims when interpreted in light of this specification and the prosecution history that follows, except where specific meanings have been set forth, and to encompass all structural and functional equivalents.

Relational terms such as "first" and "second" and the like may be used solely to distinguish one entity or action from another, without necessarily requiring or implying any actual relationship or order between them. The terms "comprises," "comprising," and any other variation thereof when used in connection with a list of elements in the specification or claims are intended to indicate that the list is not exclusive and that other elements may be included. Similarly, an element preceded by an "a" or an "an" does not, without further constraints, preclude the existence of additional elements of the identical type.

None of the claims are intended to embrace subject matter that fails to satisfy the requirement of Sections 101, 102, or 103 of the Patent Act, nor should they be interpreted in such a way. Any unintended coverage of such subject matter is hereby disclaimed. Except as just stated in this paragraph, nothing that has been stated or illustrated is intended or should be interpreted to cause a dedication of any component, step, feature, object, benefit, advantage, or equivalent to the public, regardless of whether it is or is not recited in the claims.

The abstract is provided to help the reader quickly ascertain the nature of the technical disclosure. It is submitted with the understanding that it will not be used to interpret or limit the scope or meaning of the claims. In addition, various features in the foregoing detailed description are grouped together in various embodiments to streamline the disclosure. This method of disclosure should not be interpreted as requiring claimed embodiments to require more features than are expressly recited in each claim. Rather, as the following claims reflect, inventive subject matter lies in less than all features of a single disclosed embodiment. Thus, the following claims are hereby incorporated into the detailed description, with each claim standing on its own as separately claimed subject matter.

The invention claimed is:

1. A device for providing ignition of a fuel-air mixture using a transient plasma discharge, the device comprising:

an anode configured to receive a voltage;

a cathode disposed in proximity to the anode and configured to be coupled to a ground, wherein at least one of the anode and the cathode comprises a protrusion that enhances an electric field formed between the anode and the cathode, and wherein the protrusion forms a sharp edge defining a plurality of points, each point forming a path of shortest distance between the anode and the cathode; and a pulse generator that generates a pulse having a duration of no more than a few nanoseconds and that applies this pulse across the anode and cathode so as to cause a near simultaneous transient plasma discharge between the anode and each of a plurality of the points on the cathode.

2. The device of claim 1, wherein the anode is disposed in a longitudinal axis, the cathode is disposed around the anode, and the protrusion comprises a sharp edge formed in the anode.

3. The device of claim 2, wherein the anode comprises a disc shape perpendicular to the longitudinal axis, the sharp edge is the perimeter of the disc, and the cathode is axi-symmetrically disposed around the anode.

4. The device of claim 3, wherein the disc shape has a diameter matched to an inner diameter of the cathode.

5. The device of claim 2, wherein the protrusion is one of a plurality of anode protrusions formed symmetrically around the longitudinal axis.

6. The device of claim 1, wherein the anode is disposed in a longitudinal axis, the cathode is disposed around the anode, and the protrusion is one of a plurality of cathode protrusions formed symmetrically around the anode.

7. The device of claim 1, wherein the anode is disposed in a longitudinal axis, the cathode extends around the anode, and the cathode includes apertures that allow a uniform plasma distribution around the anode, for ignition.

8. An internal combustion engine comprising:

a fuel injector and an air intake coupled to provide a fuel-air mixture;

a cavity configured to contain a combustion, the cavity comprising:

an internal surface fixed to the engine;

a piston;

an anode configured to receive a voltage;

a cathode disposed in proximity to the anode, the cathode configured to be coupled to a ground, wherein at least one of the anode and the cathode comprises a protrusion that enhances an electric field formed between the anode and the cathode, and wherein the protrusion forms a sharp edge defining a plurality of points, each point forming a path of shortest distance between the anode and the cathode; and a pulse generator that generates a pulse having a duration of no more than a few nanoseconds and that applies this pulse across the anode and cathode so as to cause a near simultaneous transient plasma discharge between the anode and each of a plurality of the points on the cathode.

9. The internal combustion engine of claim 8, wherein the cathode comprises the protrusion, the protrusion formed on a surface of the piston limiting an interior portion of the cavity.

10. The internal combustion engine of claim 8, wherein the cathode comprises the protrusion, and the protrusion is formed on the internal surface fixed to the engine.

11. The internal combustion engine of claim 8, wherein the cathode comprises an internal component protruding into the cavity, the internal component comprising the protrusion.

12. The internal combustion engine of claim 8, further comprising an insulator surrounding the anode, to prevent electric breakdown at places not including the plurality of points defined by the sharp edge.

13. The internal combustion engine of claim 8, wherein the anode is disposed in a longitudinal axis, the cathode is disposed around the anode, and the protrusion comprises a sharp edge formed in the anode.

14. The internal combustion engine of claim 13, wherein the anode comprises a disc shape perpendicular to the longitudinal axis, the sharp edge is the perimeter of the disc, and the cathode is axi-symmetrically disposed around the anode.

15. The internal combustion engine of claim 13, wherein the protrusion is one of a plurality of anode protrusions formed symmetrically around the longitudinal axis.

16. A method for igniting a fuel-air mixture with a transient plasma discharge, the method comprising:

forming a fuel-air mixture by combining an approximately stoichiometric amount of a fuel with air;

delivering the fuel-air mixture to a cavity having an anode and a cathode proximal to each other; and providing a voltage pulse to the anode having a duration of no more than a few nanoseconds, wherein at least one of the anode and the cathode comprises a protrusion that enhances an electric field formed between the anode and the cathode, and the protrusion forms a sharp edge defining a plurality of points, each point forming a path of shortest distance between the anode and the cathode, wherein the pulse causes a near simultaneous transient plasma discharge between the anode or cathode and each of a plurality of the points.

17. The method of claim 16, wherein providing a voltage pulse to the anode comprises providing a voltage of about 1 kV to about 100 kV to the anode.

18. The method of claim 16, further comprising forming a transient plasma including radicals between a point in the anode and a point in the cathode, at least one of the points in the anode and the cathode being a point in the protrusion.

19. The method of claim 16, wherein forming a fuel-air mixture with a fuel-to-air equivalence ratio slightly above one.

* * * * *